United States Patent [19]

Milzoff et al.

[11] 4,253,672

[45] Mar. 3, 1981

[54] FLEXIBLE FLYING DISC

[75] Inventors: Fred L. Milzoff, New York, N.Y.; Charles DeSaro, Morris Township, Morris County, N.J.

[73] Assignee: PFC Industries, Inc., New York, N.Y.

[21] Appl. No.: 67,462

[22] Filed: Aug. 17, 1979

[51] Int. Cl.[3] ..... A63H 27/00

[52] U.S. Cl. ..... 273/424

[58] Field of Search ..... 273/424, 425, DIG. 17; 2/184, 192, 200; 210/496, 510; 46/74 D

[56] References Cited

U.S. PATENT DOCUMENTS

| | | | |
|---|---|---|---|
| 3,026,110 | 3/1962 | Hess et al. | 273/424 X |
| 3,710,505 | 1/1973 | Linenfelser | 273/424 X |
| 4,114,885 | 9/1978 | Morrow | 273/424 |

*Primary Examiner*—Paul E. Shapiro

*Attorney, Agent, or Firm*—Natter & Natter

[57] ABSTRACT

A flexible flying disc suitable for use as an aerial projectile and advertising novelty device is formed from a circular core of pliant sheet material, e.g. foam rubber. The circular core is internally stressed by a plurality of stitches machine sewn along a marginal circumference for urging the core into a saucerlike configuration. The stitching also secures fabric covering the opposite faces of the core together with a binding strip surrounding the peripheral edge of the core and overlapping the fabric. Decorative patterns, advertising messages and other indicia can be imprinted on the fabric covering.

10 Claims, 7 Drawing Figures

FLEXIBLE FLYING DISC

BACKGROUND OF THE INVENTION

1. Field of the Invention

This invention relates to an amusement and novelty device and especially to a flexible flying disc which can be used as an aerial toy.

In particular, the flexible flying disc of this invention concerns a throwing projectile designed for cushioned impact.

2. Description of the Prior Art

The application of saucerlike flying projectiles has been widely accepted both as an active leisure pasttime and as a recreational sport.

Prior art devices developed for these purposes were generally fabricated from a rigid material such as plastic. An inherent disadvantage of those devices was that, when hurled through the air, the flying implement became a rather dangerous missile. For instance, if one of the game participants failed to catch the device, bodily injury could occur, e.g. as a result of impact to and around the face. Furthermore, an unwary bystander could accidentally be struck in the head or elsewhere because of an errant flight trajectory.

In addition, when the devices of the prior art were used indoors, windows, mirrors, table lamps and other fragile household articles were exposed to possible damage or breakage.

The device of this invention, in contrast, eliminates the aforementioned disadvantages by providing a soft, pliant and flexible disc adaptable for use as an aerodynamic toy. The spongy, elastic consistency of the disc structure provides for relatively harmless cushioned impact upon hitting an object or person.

Previous attempts to provide resiliently yieldable flying saucers usually resulted in planar discs such as typically illustrated in U.S. Pat. No. 4,114,885. Such devices did not have truly aerodynamic characteristics since there was no surface curvature or air foil design. Consequently, the planar discs were deficient in flight duration and stability, glide performance and hovering ability.

The instant invention improves upon those devices by providing a saucerlike configuration. A core of spongy material is contoured without using rigid stiffener devices or other shape holding stays. Furthermore, the device of this invention is completely safe for children, and the resilient core material is nontoxic.

In addition, this invention utilizes a fabric covering which surrounds the resilient core and provides a waterproof and durable shell.

A feature of this invention is that the fabric material provides a medium for receiving selected indicia through transfer printing or other printing processes. The visual representations can add desired decorative effects such as for creating optical illusions or otherwise attracting attention. This is particularly advantageous when the disc is to be used as an advertising or promotional item.

Another advantage of this device over the prior art is that the waterproof fabric covering is washable and the flexible flying disc itself is buoyant and can be used as a game projectile for water sports or as a pool toy.

In view of the foregoing, it should be apparent that the present invention overcomes many of the shortcomings of the prior art devices and provides an improved throwing projectile which eliminates many of the hazards of the prior art rigid structure flying saucer toys.

SUMMARY OF THE INVENTION

In compendium, the subject matter of this invention is directed to a flexible flying disc having a core formed of a resilient synthetic material such as foam rubber. The resilient material is internally stressed by sewing a circumferential line of stitches around its margin whereby the material assumes a saucerlike curved contour. The stitching is also used for securing a cloth binding strip around the peripheral edge of the core.

In addition, circular segments of fabric covering opposite faces of the resilient material can be simultaneously sewn with the binding strip.

The purpose of the flexible flying disc of this invention is to provide an aerial projectile having aerodynamic flight characteristics thus making it suitable for use as an aerial toy. The fabric covering protects the resilient material and provides a waterproof and durable shell encasement. In addition, decorative patterns and other indicia can be imprinted on the fabric covering, and the device can be used as an advertising novelty.

The utilization of the resilient material provides a flexible flying disc which is relatively safe because of its cushioning effect upon impact.

Another feature of the invention is directed to the integral contour forming stitching arrangement providing a curved air foil surface.

Having thus summarized the invention, it will be seen that an object thereof is to provide a flexible flying disc of the general character described herein which is not subject to the disadvantages of the prior art.

Specifically, it is an object of this invention to provide a flexible flying disc for use as an aerial projectile which is formed from a resilient synthetic material for cushioned impact.

It is a further object of this invention to provide a flexible flying disc which is internally stressed to form a saucerlike configuration for improved aerodynamic characteristics.

A still further object of this invention is to provide a flexible flying disc which is readily foldable for compact storage.

Another object of this invention is to provide a flexible flying disc formed of a resilient synthetic material which is light in weight, durable in strength and economical to manufacture.

Still another object of this invention is to provide a flexible flying disc formed of a resilient synthetic material having a waterproof fabric covering for providing a buoyant device.

Yet another object of this invention is to provide a flexible flying disc formed of a resilient synthetic material having a fabric covering which can be imprinted with selected indicia so that the device can be used as an advertising novelty.

The above and other objects, features and advantages of this invention will be apparent from the following description of the preferred embodiment when considered in connection with the accompanying drawings.

BRIEF DESCRIPTION OF THE DRAWINGS

In the accompanying drawings in which are shown the preferred embodiments of this invention.

DETAILED DESCRIPTION OF THE INVENTION

Figure 1:
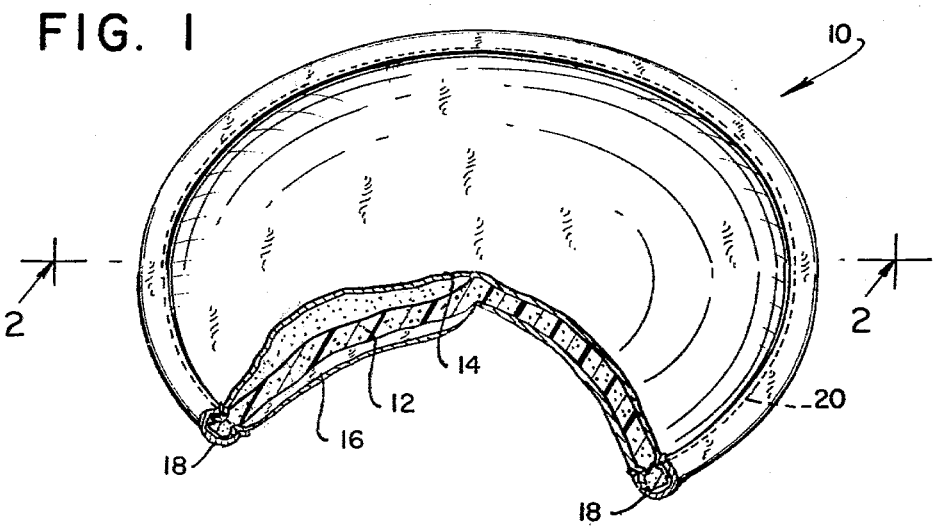
FIG. 1 is a perspective view of the flexible flying disc of this invention with a segment cut away to expose a resilient synthetic material, a fabric covering and a binding strip.

Referring now in detail to the drawings, the reference numeral 10 denotes generally a preferred embodiment of a flexible flying disc of this invention. The flexible flying disc 10, as illustrated in FIG. 1, has a curved air foil configuration. The underside of disc 10 thus forms a concave air pocket for improved flight performance when used as an aerial toy.

Figure 2:
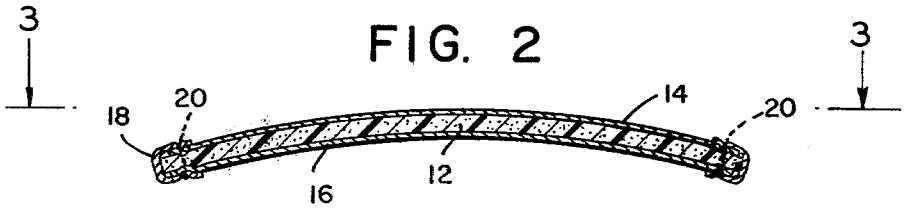
FIG. 2 is a sectional view taken substantially along line 2—2 of FIG. 1 and shows the saucerlike curved configuration of the flexible flying disc produced by the stitching which also secures the binding and fabric covering.
Figure 3:
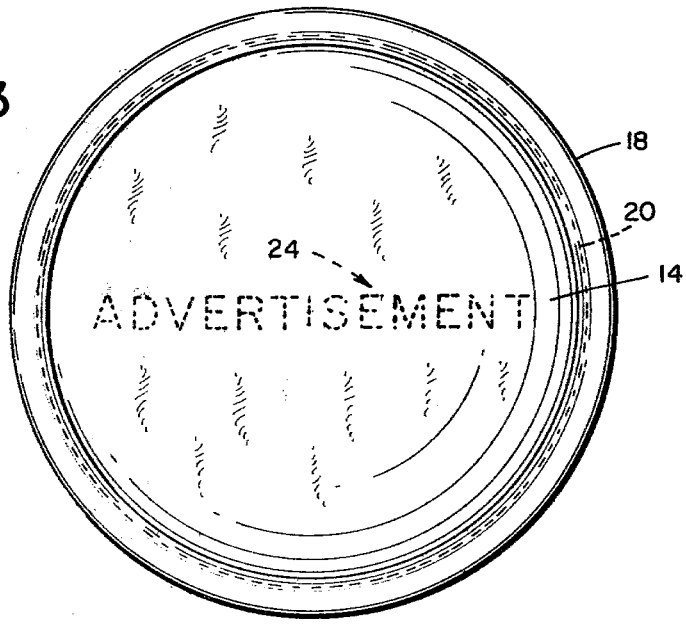
FIG. 3 is a top elevational view taken substantially along line 3—3 of FIG. 2 and shows the circumferential line of stitching together with a representative illustration for indicating the imprinting of selected advertising copy on the fabric covering.

As further shown in FIGS. 1 and 2, the flexible flying disc 10 is constructed with a circular core 12, preferably formed from a resilient synthetic material, e.g. foam rubber. In this preferred embodiment the core 12 has a diameter of about 20 centimeters and a thickness of approximately 3 millimeters. The resilient material is frequently supplied in flat stock commonly sold in rolls. It has been found convenient to die cut the sheet material to the selected dimensions thus forming a planar circular core 12. As further shown in FIGS. 1 and 2, the opposite faces of core 12 are covered by conforming fabric segments 14, 16. In addition, a linear cloth binding strip 18 of approximately 2.5 centimeters in width is sewn around a peripheral edge 22 of the core 12 and secures each of the fabric segments 14, 16.

It has been found that a plurality of stitches 20 effectively stress the resilient material forming the core 12, as will be further described hereinafter, such that the planar core 12 will assume a saucerlike curved contour.

The fabric segments 14, 16 are preferably cut from a durable, waterproof material to form a shell-like encasement for core 12. In addition, the fabric 14, 16 can be imprinted with decorative designs or an advertising message 24 by using a heat transfer process prior or subsequent to being sewn to the core 12.

It should also be realized that the construction of the flexible flying disc 10 can be modified by eliminating the fabric covering 14, 16 and the binding strip 18 or by fabricating the flexible flying disc 10 with the binding strip 18 but without the fabric covering 14, 16.

Figure 4:
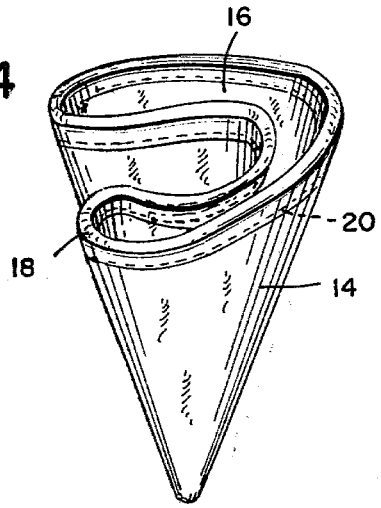
FIG. 4 is a perspective view of the flexible flying disc of this invention shown in its folded mode for compact storage.

It should be further apparent that the material selected for core 12 has a soft, spongy and elastic consistency yet provides the necessary rigidity and firmness for shape retention so that the flexible flying disc 10 can be used as an aerial game projectile. The flexible nature of the resilient material, however, functions to absorb shock upon impact and thus provides an inherent safety factor. The utilization of a yieldably tractable material for the core 12 is further advantageous in that the flexible flying disc 10 can be folded for compact storage such as in the manner illustrated in FIG. 4. Thus, the flexible flying disc 10 can be pocket carried when not in use, and the resilient material will readily assume the curved configuration when the material is released from its folded position.

Figure 5:
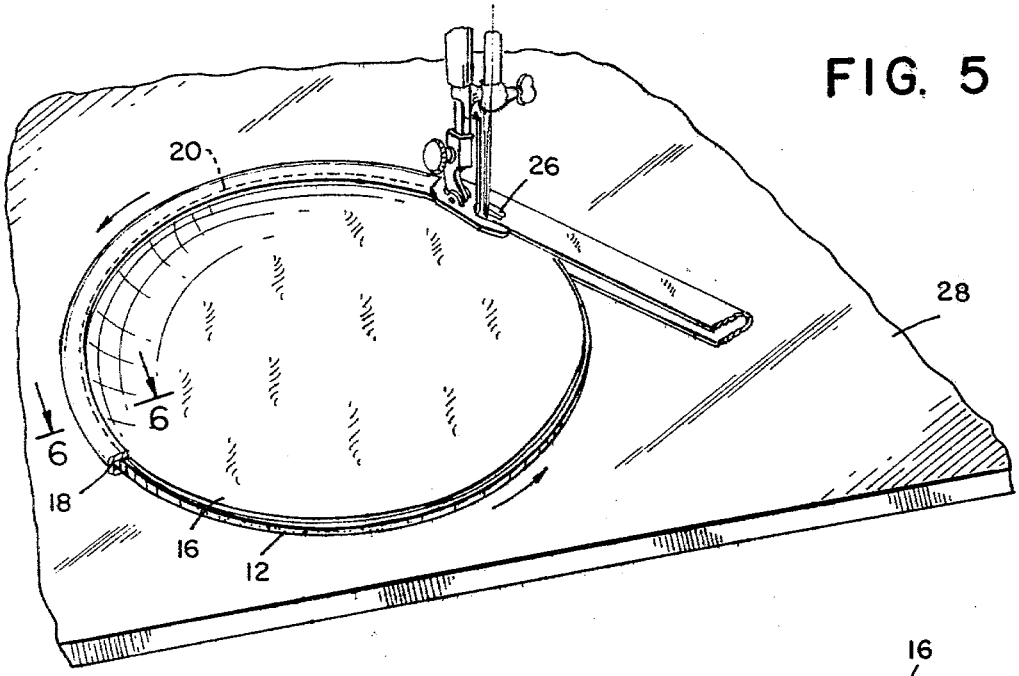
FIG. 5 shows a pictorial representation of a machine sewing process for internally stressing the flexible flying disc as well as for applying the binding strip and the fabric covering.
Figure 6:
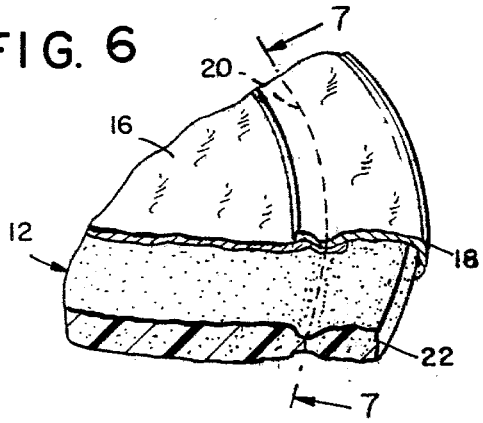
FIG. 6 is a perspective view to an enlarged scale taken substantially along line 6—6 of FIG. 5 with a portion of the binding strip cut away and shows the stitches in the resilient synthetic material for creating the internal stressing such that the material will assume a curved contour.

The sewing operation will now be described with reference being made to FIGS. 5 and 6. The circular segments of fabric 14, 16 conforming to the core 12 are placed adjacent opposite faces of the core 12, and the binding strip 18 is positioned around the exposed edge 22 of the core 12 so that the binding strip 18 will overlap the fabric covering 14, 16. A plurality of machine sewn stitches 20 extend through the binding strip 18, coverings 14, 16 and core 12 to form a seam in a conventional manner. A presser foot 26 holds the binding strip 18, fabric 16 and core 12 against a feeder dog (not shown) on a sewing machine feed table 28. The feeder dog has a tooth member for gripping the underside portion of the binding strip 18 to progressively feed it as it is being stitched. A walking foot (not shown) also grips the top portion of the binding strip 18 for simultaneous feeding. In addition, the operator gently pushes and pulls the core 12, e.g. in a counterclockwise direction as illustrated by the arrows in FIG. 5, during the sewing operation.

It has been found that the interaction of the stitches and circular movement of core 12 compresses or gathers minute linear segments of the resilient material corresponding to the spacing of the stitches 20 which shortens the circumference coincidental to the line of stitches 20. This, in turn, creates an internal stressing which urges the material upwardly, i.e. away from the sewing machine feed table, to form a curved contour. In addition, the binding strip 18 can also function to compress and curve the resilient material.

Figure 7:
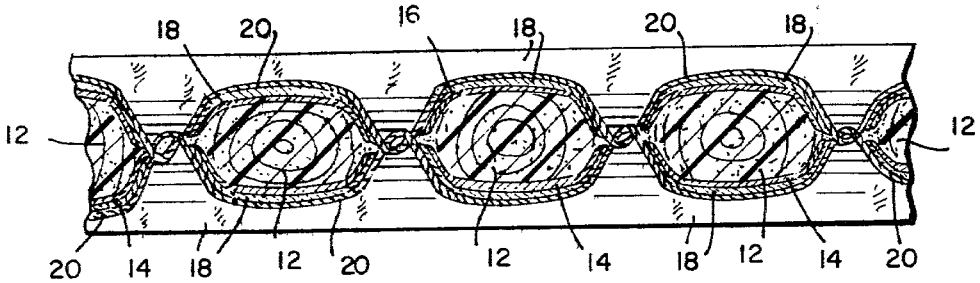
FIG. 7 is a magnified sectional view taken substantially along line 7—7 of FIG. 6 and shows a preferred lockstitch formed by the machine sewing.

The stitches 20 are sewn approximately 8 millimeters from the peripheral edge of the core. It has been found that the preferred machine stitch used is commonly known as a lockstitch, and in this instance is about 3 millimeters in length having between 2.5 and 3 stitches per centimeter. FIG. 7 illustrates a magnified vertical sectional view along the line of stitches 20. The tightness of the stitches 20 is effective to hold the resilient material compressed in both the transverse and longitudinal directions as shown in the drawings.

In the embodiment illustrated, the machine stitching is performed by a Juki (Model 563) walking foot sewing machine. It should, of course, by obvious that other industrial sewing machines can be utilized for accomplishing the same results.

It should also be noted that the flexible flying disc 10 of this invention can be applicable for purposes other than those described herein. The above cited embodiment is intended as exemplary; and while it has described the invention with specific implementation thereof, other modifications and changes might be made in this embodiment as set forth and will be apparent to those skilled in the art. Furthermore, it should be understood that all material shown and described in the accompanying drawings is to be interpreted as illustrative and not in a limiting sense, and the invention should be considered as comprehensive of all of the same which come within the scope of the appended claims.

Having thus described the invention, there is claimed as new and desired to be secured by Letters Patent:

1. A flexible flying disc adapted for use as an aerial game projectile comprising a resilient core having a substantially circular configuration defining a peripheral edge, stitching means for internally stressing said core to form a curved air foil for improved flight performance, whereby the flying disc will be cushionably yieldable upon impact and readily foldable for compact storage.

2. A flexible flying disc as claimed in claim 1 further including a binding strip, said binding strip being sewn around the peripheral edge of the core.

3. A flexible flying disc as claimed in claim 2 further including at least one segment of fabric covering a face of the disc and sewn thereto.

4. A flexible flying disc as claimed in claim 3 wherein the fabric material is adapted for receiving printed indicia.

5. A flexible flying disc as claimed in claim 1 wherein the stitching means includes a plurality of stitches circumferentially sewn through the core.

6. A flexible flying disc as claimed in claim 5 wherein the plurality of stitches are spaced inwardly from the peripheral edge of the core.

7. A flexible flying disc as claimed in claim 6 wherein the plurality of stitches are machine sewn using a lockstitch.

8. A flexible flying disc as claimed in claim 1 wherein the resilient core is formed of a synthetic foam rubber material.

9. A flexible flying disc as claimed in claim 1 further including covering means for encasing the resilient disc, said covering means being comprised of a water impervious material, whereby the core will not be subject to water penetration.

10. An advertising device in the form of a flexible flying disc comprising a resilient core having a substantially circular configuration, said core being covered by at least one conforming segment of fabric, a cloth binding strip surrounding a peripheral edge of the core, stitching means for securing the binding strip and the fabric to the core, said stitching means further being effective for internally stressing the core to urge a curved saucer shaped configuration.

* * * * *